US005190512A

United States Patent [19]

Curran

[11] Patent Number: 5,190,512

[45] Date of Patent: Mar. 2, 1993

[54] EXERCISER

[76] Inventor: Daniel J. Curran, 2369 Kingston Creek Rd., California, Md. 20619

[21] Appl. No.: 788,925

[22] Filed: Nov. 7, 1991

[51] Int. Cl.[5] ..... A63B 21/02

[52] U.S. Cl. ..... 482/124; 482/122; 482/125; 482/126

[58] Field of Search ..... 482/121, 122, 124, 125, 482/126, 148, 139

[56] References Cited

U.S. PATENT DOCUMENTS

| | | | |
|---|---|---|---|
| 866,495 | 9/1907 | Marks | 482/124 |
| 1,194,884 | 8/1916 | Sandow | 482/124 |
| 1,714,391 | 5/1929 | McWhirter | 482/148 |
| 3,051,482 | 8/1962 | Harpham | 482/124 |
| 3,256,015 | 6/1966 | Perrin | 482/121 |
| 3,425,690 | 2/1969 | Charbonnet | 482/124 |
| 3,884,464 | 5/1975 | Evangelos | 482/126 |
| 3,958,803 | 5/1976 | Geisselbrecht | 482/126 |
| 4,059,265 | 11/1977 | Wieder et al. | 482/125 |
| 4,441,707 | 4/1984 | Bosch | 482/139 |
| 4,733,861 | 3/1988 | Plunkett, III | 482/125 |
| 4,770,414 | 9/1988 | Fredrickson et al. | 482/148 |
| 4,779,867 | 10/1988 | Hinds | 482/126 |

*Primary Examiner*—Richard J. Apley

*Assistant Examiner*—Lynne Reichard

*Attorney, Agent, or Firm*—Richard C. Litman

[57] ABSTRACT

An adjustable length pole resiliently tethered at the waist to a body harness is used in exercises to condition certain selected muscles. The body harness is preferably of a type known in mountain climbing, having a belt and two straps encircling the crotch. Two elastic tubes, one on each side of a user's body, are each connected at one end to the body harness and at the other end to the pole near the ends of the pole. These tubes resiliently resist bodily movement. The effort of overcoming this resistance provides muscle conditioning. The pole terminates in enlarged, flat portions large enough to overlap the user's hands, with the palm held against the flat portions, fingers spread out. With the pole held by contact with the palms, arms outstretched laterally from the body, with the center of the pole resting on the back of the user's neck, the user twists about the spinal column to exercise the external oblique abdominal muscles. Alternatively, arm extension exercises may be performed in which the user raises and lowers the arms to further develop the oblique abdominal muscles. Lifting exercises, such as the military press, may also be used to improve arm and shoulder muscles.

3 Claims, 2 Drawing Sheets

EXERCISER

FIELD OF THE INVENTION

The present invention relates to exercising equipment, and more particularly to apparatus mounted on the body of a user.

BACKGROUND OF THE INVENTION

Those involved in weight training and muscle development have long used auxiliary equipment which may be grasped by the user or attached to the body. This equipment generally seeks to create specific forces opposing body movement, imposing a load on certain specific muscles. The resultant effort by those muscles leads to a desired improvement of body condition. A more limited objective may be to use such exercises to reduce fat deposits, especially in places on the body where unseemly bulk builds up on an otherwise trim or acceptable body shape.

Accordingly, exercising equipment has been developed to promote exercises directed to such shaping. U.S. Pat. No. 3,820,781, issued to John F. Kane on Jun. 28, 1974, is representative and is directed to waist exercisers providing a pole positioned on the back of the user's neck and cooperating in body twisting exercises. Kane uses sections screwed onto ends of the pole to increase the weight of the pole and thus the effort required to overcome the pole's inertia during exercises.

Tethered attachement to the body is shown in U.S. Pat. No. 4,277,062, issued to Mark Lawrence on Jul. 7, 1981. However, the Lawrence invention is not usable for twisting exercises to improve the waist.

Integral resistance within the equipment is illustrated in U.S. Pat. No. 4,623,146, issued to Byron R. Jackson on Nov. 18, 1986. There is no anchoring at the waist area of the user, and resistance operating in the same direction as that provided in the present invention is absent.

SUMMARY OF THE INVENTION

By the present invention, an improved waist exerciser is disclosed which provides a novel arrangement of attachments to the user's body and directions of resisting forces acting on the user. A special object of attention, particularly to those who are not generally inclined to develop musculature but who seek to control the loss of a youthful figure, is the external oblique abdominal muscles. Fat deposits in these areas are popularly if informally known as "love handles".

The present invention is particularly suited to elimination of these fat deposits as well as to development of arm and shoulder muscles.

A pole is held horizontally on the back of the neck with the user's arms extended straight out, cruciform style. Resilient, elastic tubing attaches to the pole and is anchored to a harness secured to the user's waist area. When the user twists about his spinal column, the effort of extending the twist to the greatest extent, thus opposing the resistance of the elastic tubing, exercises the desired muscles. In an alternative exercise procedure using the exerciser of the present invention, the arms are raised and lowered to further isolate the external oblique abdominal muscles and promote their development.

Accordingly, an object of the present invention is to provide exercising equipment resisting a bodily twisting motion about the spinal column.

Another object is to provide exercising equipment which is uncomplicated and inexpensive.

A third object is to provide exercising equipment which may quickly and easily be assembled and attached for use.

With these and other objects in view which will more readily appear as the nature of the invention is better understood, the invention consists in the novel combination and assembly of parts hereinafter more fully described, illustrated and claimed with reference being made to the attached drawings.

DESCRIPTION OF THE PREFERRED EMBODIMENT

Figure 1:
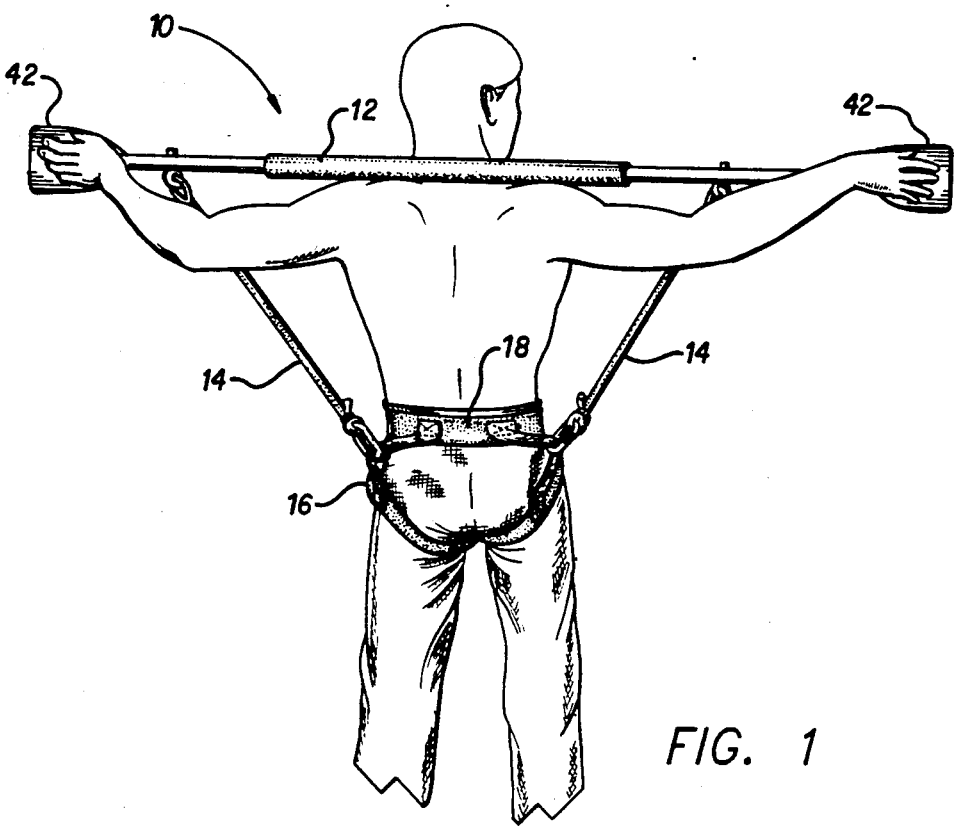
FIG. 1 is a rear perspective view of the invention in use.

The present invention 10 includes an extensible pole 12, elastic tubing 14, and a body harness 16. The body harness 16, as will be evident to those familiar with mountain climbing, is a well known type having a belt 18 encircling the waist and straps 20*a*, 20*b* encircling the crotch.

Figure 2:
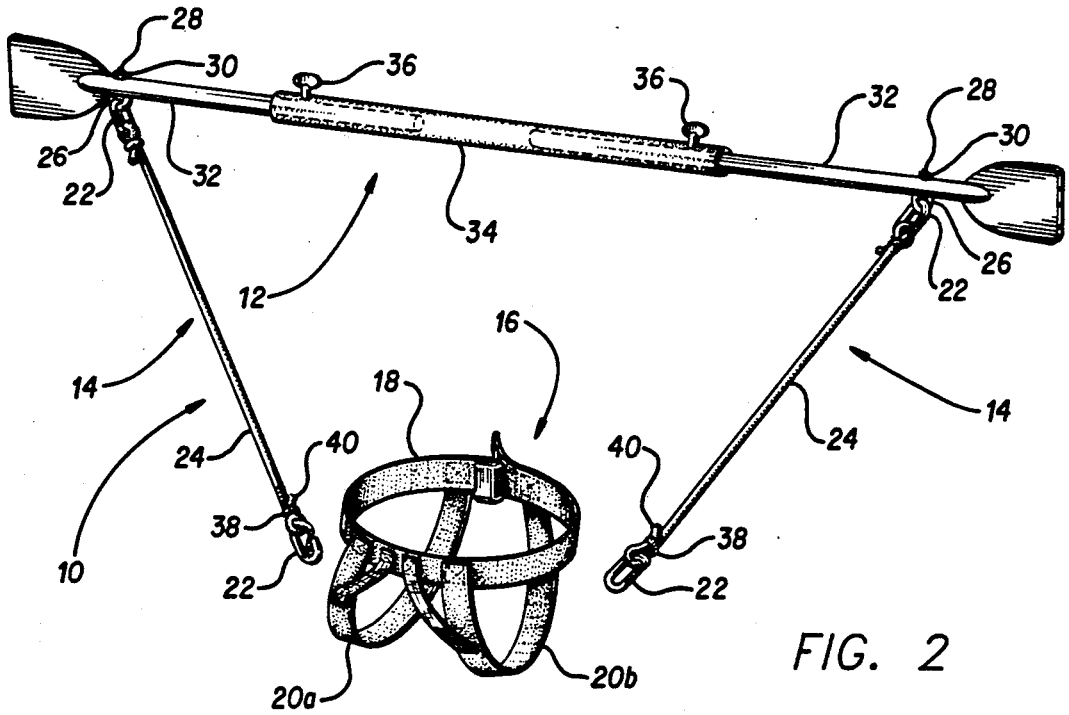
FIG. 2 is a perspective view of the invention as in use, but omitting the user, drawn to enlarged scale.

Construction of the invention 10 is best illustrated in FIG. 2. Anchored by two releasable fastener devices or clips 22 to the belt 18 of the body harness 16 are two sections 24 of elastic tubing 14 extending to the pole 12. These clips 22 are well known to those familiar with mountain climbing as "Caribbean clips", providing quick, convenient disconnection for the tubing 14. Similar clips 22 are attached to eyes 26 fixed to the pole 12, as by studs 28 penetrating the pole 12 and being secured by threaded fasteners 30.

The pole 12 is adjustably extensible. Outer segments 32 are telescopically mounted on the pole central segment 34. Central segment 34 may be encased by a tubular section of cushioning material (not shown) to provide user comfort during exercising. After withdrawing the outer segments 32 to attain a desired length, thumbscrews 36 secure the outer segments 32 to the central segment 34. The outer segments 32 of the pole 12 terminate in enlarged, flat sections 42. These flat sections are large enough to overlap a user's hand laid flat thereupon.

The present invention 10 may be used wearing any style of clothing. Certain adjustments are made to accommodate the individual user. The belt 18 and straps 20*a*, 20*b* encircling the crotch are adjusted conventionally to attain a satisfactory fit. The outer segments 32 of the pole 12 are secured in place relative to the central segment 34 after extension to a desired length. Finally, each length of the sections 24 of elastic tubing 14 spanning the body harness 16 and the pole 12 is adjusted by slackening a screw clamp 38 on each caribbean clip 22 and pulling a free end 40 of the section 24 of elastic tubing 14 therethrough.

Figure 3:
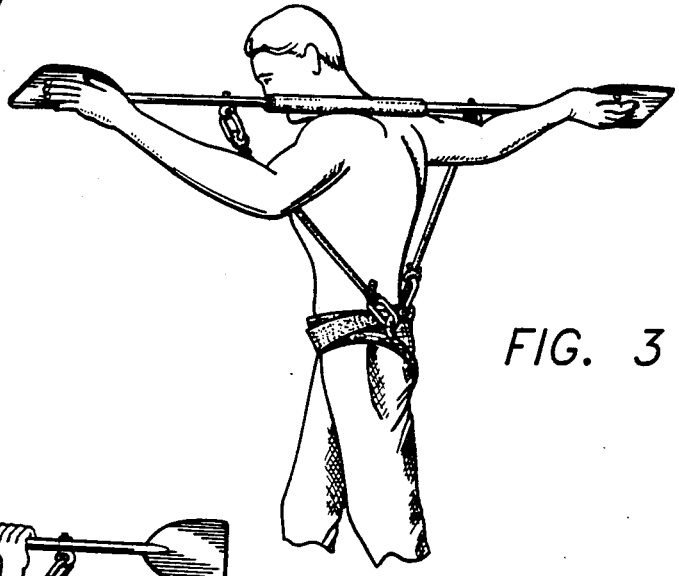
FIG. 3 is a perspective view of the invention showing it in use for twisting exercises.

In a preferred method of use, the user grasps the pole 12 by placing it between the back of the neck and the hands, as shown in FIG. 1. To improve the external oblique abdominal muscles, the user twists about his spinal column, the hips being substantially stationary, and the shoulders being forced to twist as much as possible against the resistance of the elastic tubing 14. A user partially completing a twist is shown in FIG. 3.

Preferably, the user twists maximally in a first direction, then reverses direction to twist maximally in the opposite direction. This procedure is then repeated as desired.

For twisting exercises, the user will likely prefer to hold the pole 12 by partially encircling the pole with his arms and allowing the hands to lie flat with palms against the flat sections 42. This is considerably more comfortable than maintaining a tight hand grip on the pole 12, enables the user to exert considerable force in twisting about the waist, and has no detrimental effect on body conditioning based on twisting.

Figure 4:
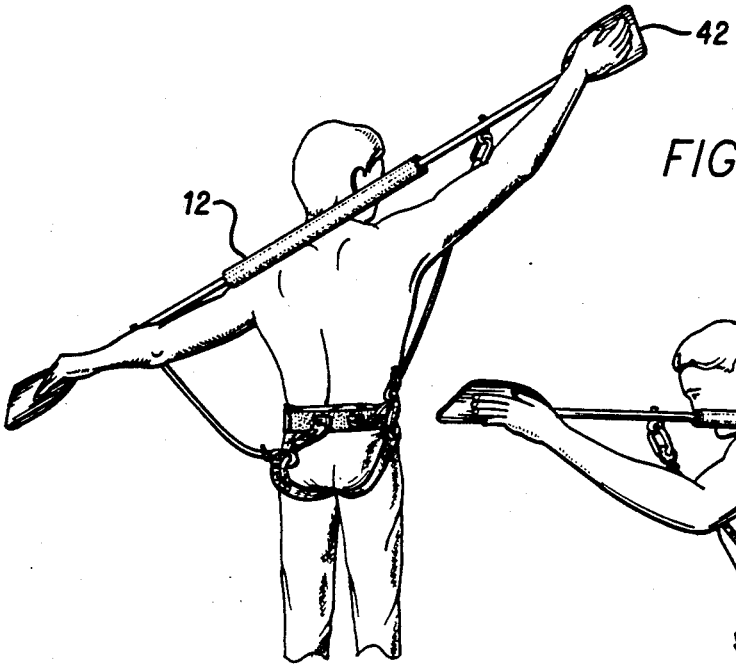
FIG. 4 is a perspective view of the invention showing it in use for arm extension exercises.

Another exercise promoting oblique abdominal muscle development may be practiced using the present invention 10 without modification of its structure. As seen in FIG. 4, oblique abdominal muscles may be isolated and exercised by raising one end 42 of the pole 12 with one arm, the other arm being lowered. This stretches the raised arm and compresses the lowered arm, whereby the isolated oblique abdominal muscles are exercised.

Figure 5A:
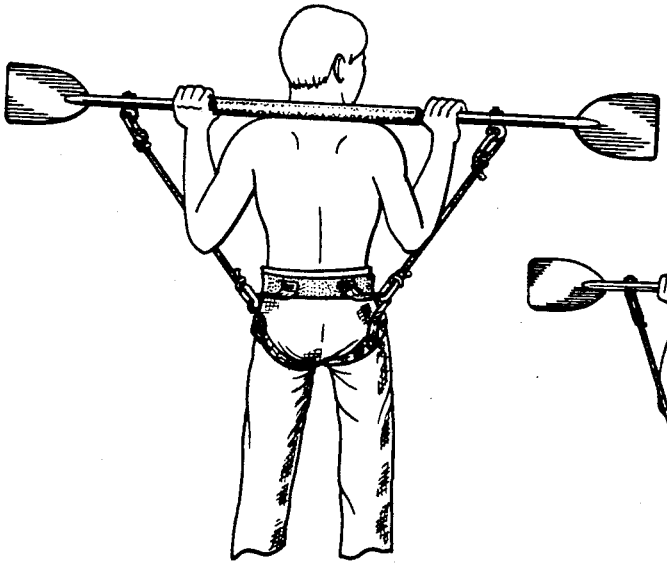
FIG. 5A is a perspective view of the invention showing its use with the military press, the user having partially raised his arms.
Figure 5B:
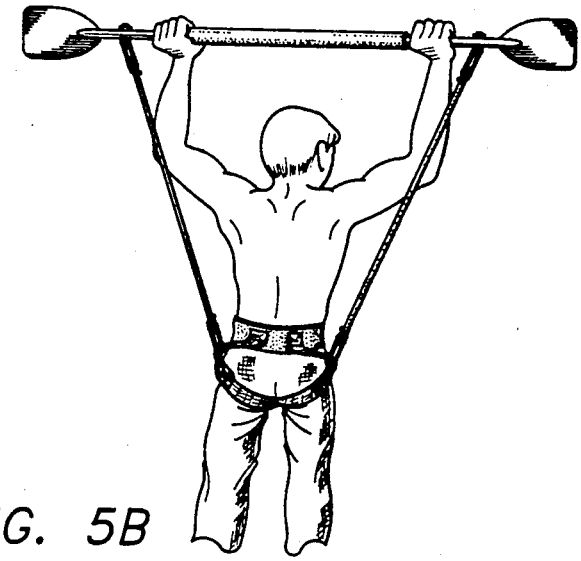
FIG. 5B is a perspective view of the invention as shown in FIG. 5A, the user having fully extended his arms.

Another exercise is the well known military press, shown initially in FIG. 5A and at full extension in FIG. 5B.

It is to be understood that the present invention is not limited to the sole embodiment described above, but encompasses any and all embodiments within the scope of the following claims.

I claim:

1. Exercising apparatus comprising:

an extensible pole having a central segment and first and second outer segments, each having an outer end, said first and second outer segments being concentric and axially slidably adjustable relative to said central segment;

a body harness for engaging the midsection of a user including a belt and a plurality of flexible straps for encircling the crotch of a user; and a plurality of elastic, substantially linear flexible members, each of said elastic, substantially linear flexible members being attached to one end to said extensible pole segment outer ends and being attached at the other end to said body harness, at least one of said ends of said elastic, substantially linear flexible members being adjustable as to length, each of said elastic, substantially linear flexible members being anchored at one end to a respective one of said flexible straps, whereby movement of said extensible pole during exercising is yieldably resisted by said elastic, substantially linear flexible members, muscles of the body thereby being forced to exert increased effort.

2. The invention as claimed in claim 1, said first and second outer segments terminating in flat portions, whereby said flat portions may be held by application of pressure by the palms of a user's hands, thus avoiding the necessity of grasping said pole.

3. The invention as claimed in claim 1, including releasable fastener means for providing attachment of said elastic, substantially linear members to said extensible pole segment outer ends and said body harness.

* * * * *